US008066177B2

(12) United States Patent
Tanaka

(10) Patent No.: US 8,066,177 B2
(45) Date of Patent: Nov. 29, 2011

(54) RECEPTACLES, SUCH AS BOXES, AND PACKAGING ARRANGEMENTS WHICH INCLUDE SUCH RECEPTACLES

(75) Inventor: Miki Tanaka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 269 days.

(21) Appl. No.: 12/392,925

(22) Filed: Feb. 25, 2009

(65) Prior Publication Data

US 2009/0218389 A1 Sep. 3, 2009

(30) Foreign Application Priority Data

Feb. 29, 2008 (JP) ..... 2008-051017

(51) Int. Cl.
*B65D 5/00* (2006.01)

(52) U.S. Cl. ..... 229/131.1; 229/131; 229/120.03; 229/143; 229/229

(58) Field of Classification Search ..... 206/264, 206/268, 576, 1.9; 229/148, 153, 229, 243, 229/244, 120.03, 131, 131.1, 231
See application file for complete search history.

(56) References Cited

U.S. PATENT DOCUMENTS

| | | | | | |
|---|---|---|---|---|---|
| 1,256,965 | A * | 2/1918 | Williams | 206/256 |
| 1,306,574 | A * | 6/1919 | Boerlin | 229/131.1 |
| 2,594,504 | A * | 4/1952 | Schmirler | 206/521.1 |
| 2,955,736 | A * | 10/1960 | Annen, Sr. | 206/521.7 |
| 3,112,854 | A * | 12/1963 | Persson | 229/154 |
| 4,826,016 | A * | 5/1989 | Foster | 229/120.011 |
| 5,064,072 | A * | 11/1991 | Nakamura | 229/120.03 |
| 6,860,421 | B2 * | 3/2005 | Lo Duca | 229/102 |
| 7,234,631 | B2 * | 6/2007 | Ichikawa et al. | 229/122 |
| 2005/0116016 | A1 * | 6/2005 | Lo Duca | 229/121 |

FOREIGN PATENT DOCUMENTS

| | | | |
|---|---|---|---|
| CN | 2287125 | Y | 8/1998 |
| JP | S61-180919 | U | 11/1986 |
| JP | H02-031820 | U | 2/1990 |
| JP | H10-119958 | A | 5/1998 |
| JP | 3058408 | U | 3/1999 |
| JP | 2001-080633 | A | 3/2001 |

(Continued)

OTHER PUBLICATIONS

Hawkeye Corrugated Box Co. "Corrugated 101" 2006.*

(Continued)

*Primary Examiner* — David T Fidei
(74) *Attorney, Agent, or Firm* — Baker Botts L.L.P.

(57) ABSTRACT

A receptacle includes a first panel, a second panel opposite the first panel, and a third panel contiguous with the first and second panels on different sides. An opening is formed between a first side of the first panel and a second side of the second panel. A lid covers the opening. A first portion of the lid is contiguous with the first side of the first panel and with a second portion of the lid that folds into an interior of the receptacle. One of the first and second panels has a perforation extending from a first end of the second side of the one of the first and second panels to a second end of the second side of the one of the first and second panels. A portion of the perforation is positioned away from the second side of the one of the first and second panels.

20 Claims, 12 Drawing Sheets

FOREIGN PATENT DOCUMENTS

| | | | |
|---|---|---|---|
| JP | 2003-128050 | A | 5/2003 |
| JP | 2006-151464 | A | 6/2006 |
| JP | 2006-240643 | A | 9/2006 |
| JP | 2007-084077 | A | 4/2007 |
| JP | 2007-126194 | A | 5/2007 |
| JP | 2007-230593 | A | 9/2007 |

OTHER PUBLICATIONS

The State Intellectual Property Office of the People's Republic of China; Notification of First Office Action in Chinese Patent Application No. CN200910126601.6 (counterpart to the above-captioned US application) mailed May 12, 2010.

The State Intellectual Property Office of the People'S Republic of China; Notification of Third Office Action in Chinese Patent Application No. CN200910126601.6 (counterpart to the above-captioned US application) mailed Aug. 24, 2011.

* cited by examiner

RECEPTACLES, SUCH AS BOXES, AND PACKAGING ARRANGEMENTS WHICH INCLUDE SUCH RECEPTACLES

CROSS-REFERENCE TO RELATED APPLICATION

The present application claims priority from Japanese Patent Application No. JP-2008-51017, which was filed on Feb. 29, 2008, the disclosure of which is incorporated herein by reference in its entirety.

BACKGROUND OF THE INVENTION

1. Field of the Invention

The present invention relates to receptacles, such as boxes, enclosing a commercial product and packaging arrangements comprising a receptacle enclosing an ink cartridge to be used with an image printing apparatus.

2. Description of Related Art

It is known to package an ink cartridge, which is used with an image printing apparatus, such as an inkjet printer, in a packaging bag in a depressurized state, and to enclose the packed ink cartridge in a paper box, which is distributed to market. Known paper boxes are used not only for enclosing an ink cartridge, but also for enclosing many kinds of commercial products.

Referring to FIGS. 10 and 11, a known paper box 130, such as the paper box described in JP-A-2003-128050, can be closed again after the box has been opened. Paper box 130 has substantially a hexahedron shape having a front panel 131, a left-side panel 132, a right-side panel 133, an upper-side panel 134, a lower-side panel 135, and a back panel 136. To build paper box 130, front panel 131 and back panel 136 are folded with respect to lower-side panel 135, and then upper-side panel 134 is glued on a bonding surface 140. Accordingly, a double-layered lid 147, including bonding surface 140 and upper-side panel 134, is formed. Subsequently, left-side panel 132 is glued on a left-side folding panel 138, such that left-side face of paper box 130 is closed. A commercial product then is inserted into paper box 130 from the right-side face of paper box 130, which is open. Subsequently, right-side panel 133 is glued on a right-side folding panel 139, such that the right-side face of paperbox 130 is closed, and the building of paperbox 130 is complete. A perforated line 145 is formed in a folded portion between back panel 136 and bonding surface 140, except for the center portion of the folded portion. Back panel 136 has a semicircular perforated line 144 formed therein, and semicircular perforated line 144 is connected to perforated line 145. Consequently, a push-in area 141 defined by the folded portion and perforated line 144 is formed in back panel 136.

To open paper box 130, push-in area 141 is pushed into an interior of paper box 130, such that back panel 136 is broken along perforated line 144. Subsequently, lid 147 is rotated upward about a folded portion between front panel 131 and upper side panel 134. When this occurs, the folded portion between bonding surface 140 and back panel 136 is broken along perforated line 145, and then the upper face of paper box 130 is opened. Back panel 136 has a cut 142 formed therethrough. When a user intends to close paper box 130 again, an upper-side of a hanging panel 143 extending from upper-side panel 134 is turned and oriented downward and then is inserted into cut 142. Accordingly, hanging panel 143 engages with back panel 136, and the upper face of paper box 130 is closed.

Lid 147 of paper box 130 is reinforced by upper-side panel 134 being glued on bonding surface 140, i.e., lid 147 is double-layered. Therefore, paper box 130 is opened without breaking portions of paper box 130 other than perforated lines 144 and 145. Nevertheless, in order to reinforce lid 147, upper-side panel 134 is glued to bonding surface 140 when paper box 130 is built, which complicates the building of paper box 130.

Moreover, right-side panel 133 is glued on right-side folding panel 139, and left-side panel 132 is glued on left-side folding panel 138. Covering the openings of paper box 130 by gluing portions of paper box 130 complicates the building of paper box 130.

Referring to FIG. 12, another known paper box, such as the paper box described in JP-A-10-119958, can indicate whether the paper box previously has been opened. Paper box 110 has a front panel 113, a back panel 118 opposite front panel 113, and a lid 111 which is contiguous with back panel 118. Lid 111 has an upper panel 115 contiguous with back panel 118, and a distal strip 114 extending from upper panel 115. Lid 111 is configured to be folded, such that distal strip 114 is positioned in an interior of paper box 110. Front panel 113 has a perforated line 117 formed therein at a position which distal strip 114 contacts, when the box is closed. Perforated line 117 has a substantially arcuate shape extending from the upper side of front panel 113 toward the center of front panel 113. A push-in area 112 defined by perforated line 117 is formed at front panel 113. An index portion 120 is formed inside push-in area 112. Index portion 120 is defined by a portion of perforated line 117 and a perforated line 119. Index portion 120 is configured to be separatable from push-in area 112 along a portion of perforated line 117 and a portion of perforated line 119. Push-in area 112 is glued to distal strip 114. The glue is not applied to perforated lines 117 and 119.

Paper box 110 may be opened in such a manner that lid 111 is opened without separating push-in area 112 from front panel 113. When such an opening is carried out, front panel 113 is broken along the portion of perforated line 117 and the portion of perforated line 119 surrounding index portion 120 when lid 111 is pulled upward, and then index portion 120 is removed from front panel 113. Consequently, an opening is formed at a portion of front panel 113 where index portion 120 was removed. This opening indicates that paper box 110 previously has been opened.

When the distance between front panel 113 and back panel 118 of paper box 110 is increased, the length of distal strip 114 extending from upper panel 115 may need to be increased to close lid 111 securely. When the length of distal strip 114 is increased, distal strip 114 may interfere with a product enclosed in paper box 110 when paper box 110 is opened, which may make it difficult to open paper box 110.

The previous opening of paper box 130 may be recognized when index portion 120 is found removed from push-in area 112. Nevertheless, if distal strip 114 is glued to the inner surface of front panel 113 after paper box 110 is opened, index portion 120 may be at the same position as before paper box 110 was opened. In such a case, it may be difficult to recognize the previous opening of paper box 110.

SUMMARY OF THE INVENTION

Therefore, a need has arisen for receptacles and packaging arrangements which overcome these and other shortcomings of the related art. A technical advantage of the present invention is that a receptacle, e.g., a box, readily may be built and opened, and a previous opening of the box readily may be recognized. Another technical advantage of the present invention is that an opening of a box through which a product is inserted into the box reliably may be closed without using glue.

According to an embodiment of the present invention, a receptacle, such as a box, comprises a first panel, a second panel opposite the first panel, and a third panel contiguous with the first panel and the second panel. Each of the first, second, and third panels comprises a first side and a second side. An opening is formed between the first side of the first panel and the first side of the second panel. A lid covers the opening and comprises a first portion and a second portion contiguous with the first portion of the lid. In addition, the first portion of the lid is contiguous with the first side of the first panel, and a second portion of the lid is folded such that it is positioned in an interior of the receptacle. The first side of the third panel is contiguous with the second side of the first panel, and the second side of the third panel is contiguous with the second side of the second panel. Either the first panel has a perforation formed therein, the perforation extends from a first end of the second side of the first panel to a second end of the second side of the first panel, and at least a portion of the perforation is positioned away from the second side of the first panel; or, the second panel has a perforation formed therein, the perforation extends from a first end of the second side of the second panel to a second end of the second side of the second panel, and at least a portion of the perforation is positioned away from the second side of the second panel.

According to another embodiment of the present invention, a packaging arrangement comprises a receptacle, such as a box. The receptacle comprises a first panel, a second panel opposite the first panel, and a third panel contiguous with the first panel and the second panel. Each of the first, second, and third panels comprises a first side and a second side. An opening is formed between the first side of the first panel and the second side of the second panel. A lid covers the opening and comprises a first portion and a second portion contiguous with the first portion of the lid. In addition, the first portion of the lid is contiguous with the first side of the first panel, and a second portion of the lid is folded such that it is positioned in an interior of the receptacle. The first side of the third panel is contiguous with the second side of the first panel, and the second side of the third panel is contiguous with the second side of the second panel. Either the first panel has a perforation formed therein, the perforation extends from a first end of the second side of the first panel to a second end of the second side of the first panel, and at least a portion of the perforation is positioned away from the second side of the first panel; or, the second panel has a perforation formed therein, the perforation extends from a first end of the second side of the second panel to a second end of the second side of the second panel, and at least a portion of the perforation is positioned away from the second side of the second panel. An ink cartridge is enclosed in the receptacle.

Other objects, features, and advantages of embodiments of the present invention will be apparent to persons of ordinary skill in the art from the following description of embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Figure 1:
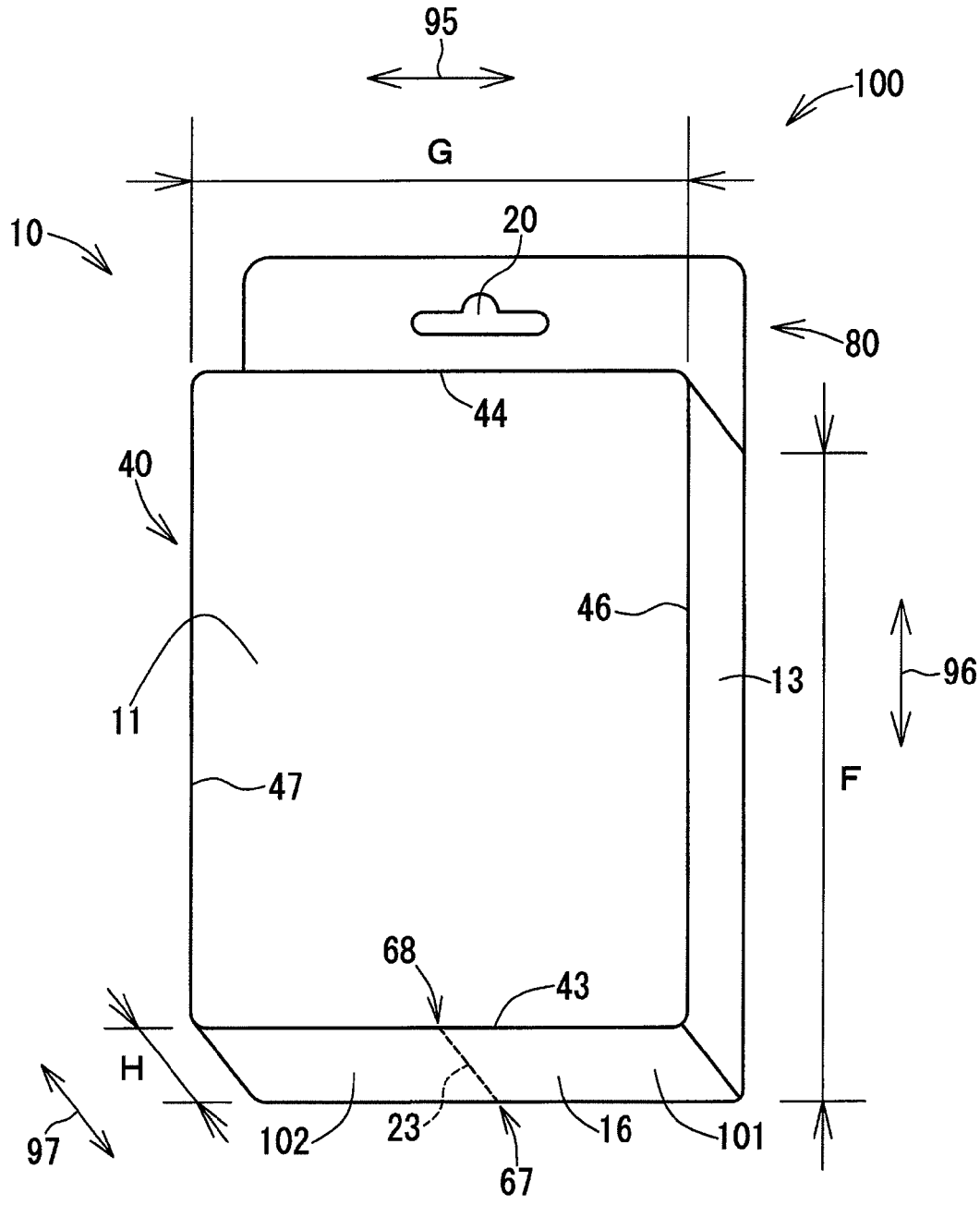
FIG. 1 is a perspective view of a packaging arrangement, according to an embodiment of the present invention, in which a front face of the packaging arrangement is shown.

Embodiments of the invention and their features and technical advantages may be understood by referring to FIGS. 1 to 9, like numerals being used for like corresponding portions in the various drawings.

Referring to FIGS. 1 to 4, a packaging arrangement 100 according to an embodiment of the present invention is described. Packaging arrangement 100 may comprise a receptacle, such as a box 10, and an ink cartridge 90, enclosed in box 10. Ink cartridge 90 may be configured to store ink therein, and may be configured to be used with an image printing apparatus, such as an inkjet printer to print an image with ink. Ink cartridge 90 may have a substantially flat, hexahedron shape. More specifically, ink cartridge 90 may have a substantially parallelepiped shape, having a dimension L in a height direction 106, a dimension N in a depth direction 105, and a dimension M in a width direction 107. Dimensions L and M may be greater than dimension N. Ink cartridge 90 may be packed in a packaging bag in a depressurized state, and packed ink cartridge 90 may be enclosed in box 10. In other embodiments, another commercial product, such as a food product, may be enclosed in box 10.

Box 10 may comprise paper, e.g. cardboard. In another embodiment, box 10 may comprise soft plastic. Box 10 may comprise a body portion 40, and a hanging portion 80. Body portion 40 and hanging portion 80 may comprise a single paper board 30. Therefore, body portion 40 and hanging portion 80 may be integral. Body portion 40 may have a flat hexahedron shape, and may enclose ink cartridge 90.

Hanging portion 80 may have a hanging opening 20 formed therethrough. Hanging opening 20 may extend through hanging portion 80 in a thickness direction 97, i.e., in a direction substantially perpendicular to the paper plane of FIG. 1. When packaging arrangement 100 is displayed, a supporting rod (not shown) extending horizontally in a display rack may be inserted into hanging opening 20, such that packaging arrangement 100 hangs on the supporting rod.

Figure 4:
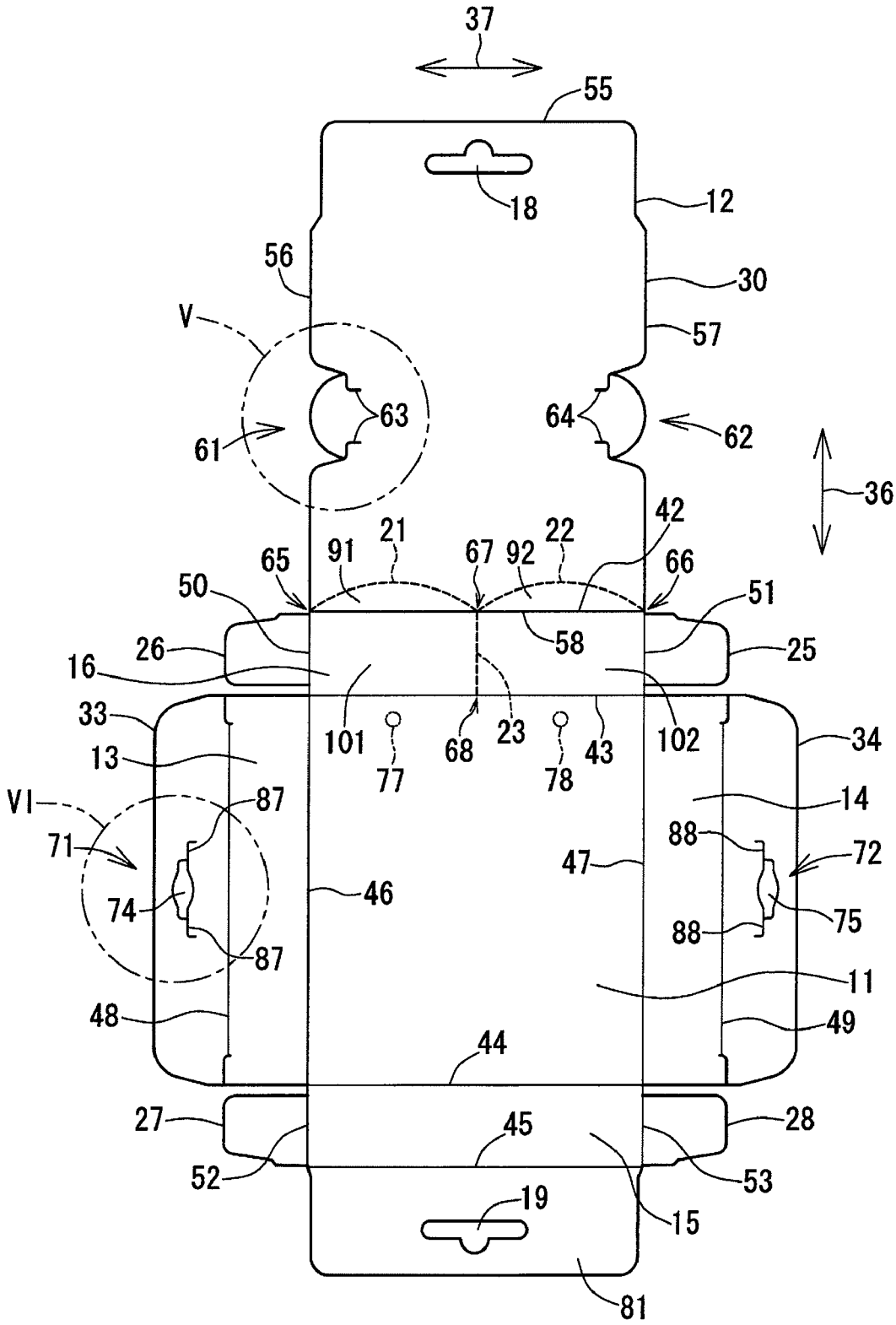
FIG. 4 is a development view of a box, according to an embodiment of the present invention.

Referring to FIG. 4, box 10 may be built by folding a single paper board 30 into a box shape. Paper board 30 may be a thin paper having a uniform thickness. The strength of the respective portion of paper board 30 may be uniform. For example, the thickness of paper board 30 may be about 0.2 mm. Paper board 30 may comprise a plurality of folding lines 42-53. Paper board 30 may be sectionalized into a back panel 12, a lower panel 16, a front panel 11, an upper panel 15, hanger panel 81, lid panels 13, 14, distal strips 33, 34, and tongue strips 25-28. Front panel 11, back panel 12, upper panel 15, lower panel 16, lid panel 13, and lid panel 14 form six faces of box 10. Folding line 42 corresponds to a lower end 58 of back panel 12 and a back end of lower panel 16. Folding line 43 corresponds to a lower end of front panel 11 and a front end of lower panel 16. Folding line 44 corresponds to an upper end of front panel 11 and a front end of upper panel 15. Folding line 45 corresponds to a back end of upper panel 15. Folding line 46 corresponds to a left end of front panel 11 and a front end of lid panel 13. Folding line 47 corresponds to a right end of front panel 11 and a front end of lid panel 14. As used herein, the term "side" means the border, boundary, or edge.

Referring to FIG. 1, body portion 40 of box 10 may have a hexahedron shape having a dimension G in a width direction 95 of body portion 40, a dimension F in a height direction 96 of body portion 40, and a dimension H in a depth direction 97 of body portion 40. Dimension G may be greater than dimension H, and dimension F may be greater than dimension G. Ink cartridge 90 may be enclosed in body portion 40, such that depth direction 105 of ink cartridge 90 is aligned with depth direction 97 of body portion 40, width direction 107 of ink cartridge 90 is aligned with height direction 96 of body portion 40, and height direction 106 of ink cartridge 90 is aligned with width direction 95 of body portion 40. Therefore, dimension H of body portion 40 may be slightly greater than dimension N of ink cartridge 90, dimension F of body portion 40 may be greater than dimension M of ink cartridge 90, and dimension G of body portion 40 may be slightly greater than dimension L of ink cartridge 90. Front panel 11, back panel 12, upper panel 15, lower panel 16, lid panel 13, and lid panel 14 may be parallel to the opposing panels and perpendicular to the other panels.

Figure 2:
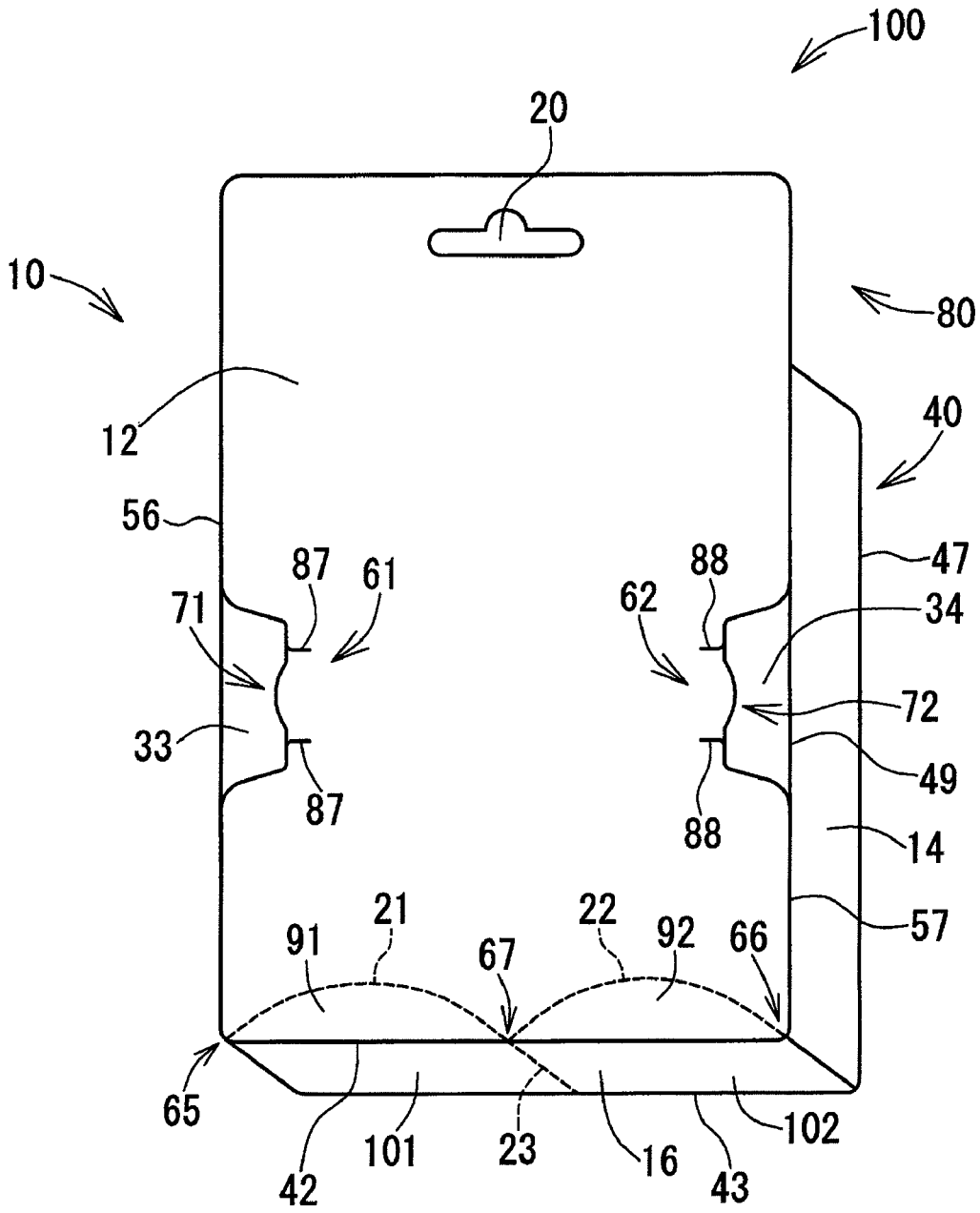
FIG. 2 is a perspective view of the packaging arrangement of FIG. 1, in which a back face of the packaging arrangement is shown.
Figure 3:
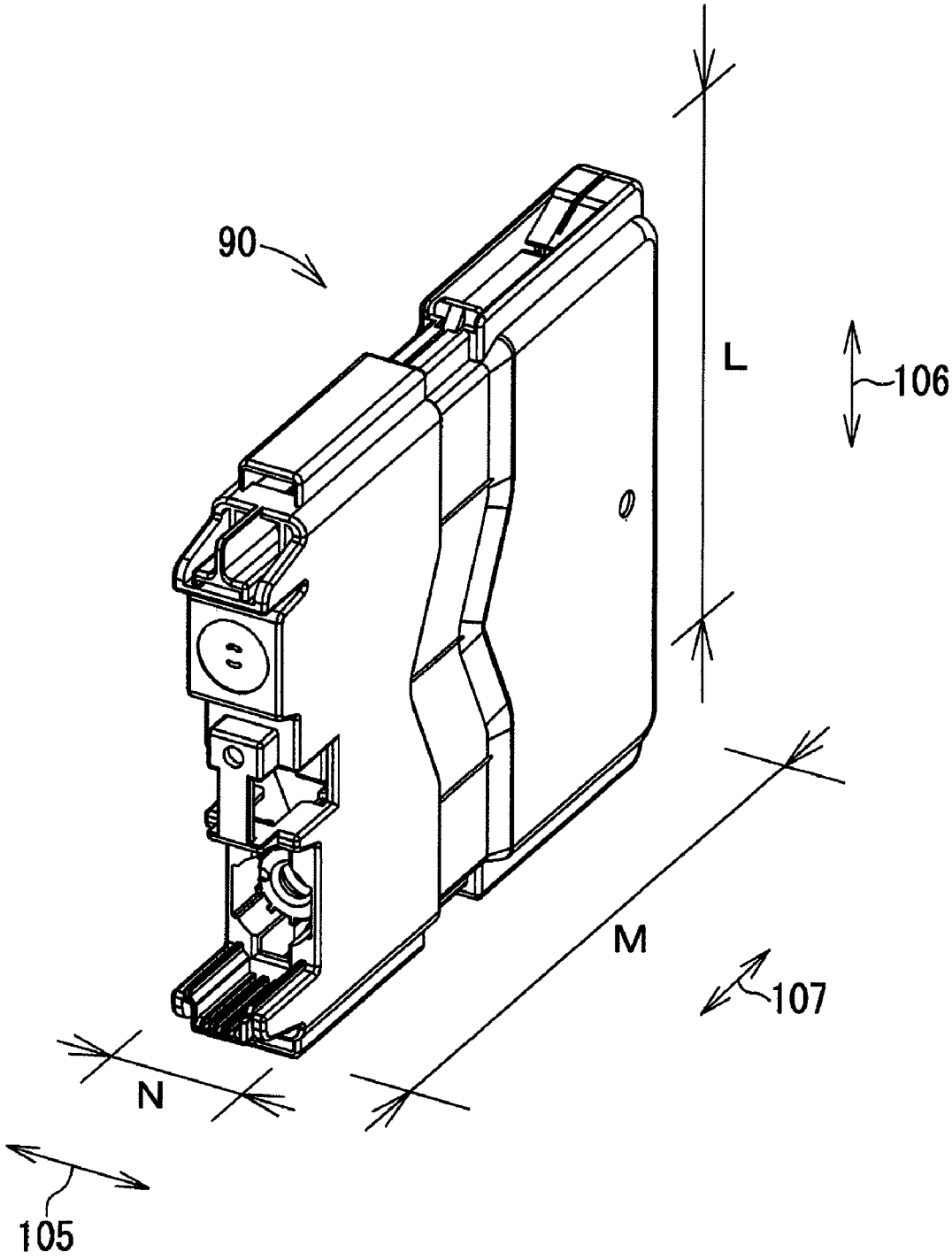
FIG. 3 is a perspective view of an ink cartridge, according to an embodiment of the present invention.

Referring to FIGS. 1, 2, and 4, front panel 11 may be contiguous with upper panel 15, lid panel 13, lid panel 14, and lower panel 16. As used herein, the term "contiguous" means to be integrally formed with an adjacent panel or side without being connected with glue or the like. Upper panel 15 may be folded along folding line 44 with respect to front panel 11, thereby forming a right angle therebetween. Lid panel 13 may be folded along folding line 46 with respect to front panel 11, thereby forming a right angle therebetween. Lid panel 14 may be folded along folding line 47 with respect to front panel 11, thereby forming a right angle therebetween. Lower panel 16 may be folded along folding line 43 with respect to front panel 11, thereby forming a right angle therebetween.

Referring to FIG. 4, back panel 12 may have a hanging opening 18 formed therethrough adjacent to upper side 55 of back panel 12. As used herein, the term "side" means the border, boundary, or edge. Hanging opening 18 may be longer in a width direction 37 than in a height direction 36. Hanger panel 81 may have a hanging opening 19 at a position corresponding to hanging opening 18, when the box is formed. Hanging opening 18 and hanging opening 19 may have substantially the same shape and substantially the same size.

Referring to FIGS. 1, 2, and 4, back panel 12 may be contiguous with lower panel 16. Folding line 42 extending in width direction 37 may be formed between back panel 12 and lower panel 16. Back panel 12 may be folded along folding line 42 with respect to lower panel 16, thereby forming a right angle therebetween. As descried above, front panel 11 may be folded along folding line 43 with respect to lower panel 16, thereby forming a right angle therebetween. Accordingly, front panel 11 and back panel 12 may be positioned so as to oppose each other at a predetermined distance. Hanger panel 81 may be contiguous with upper panel 15. Hanger panel 81 may be folded along folding line 45 with respect to upper panel 15, thereby forming a right angle therebetween. As described above, back panel 12 and front panel 11 may be folded with respect to lower panel 16; upper panel 15 may be folded with respect to front panel 11; and hanger panel 81 may be folded with respect to upper panel 15. Accordingly, hanger panel 81 may contact an upper portion of back panel 12, including upper side 55 of back panel 12. Hanger panel 81 may be glued to the upper portion of back panel 12. Hanging portion 80 may comprise the upper portion of back panel 12 and hanger panel 81 glued together. Hanging portion 80 may extend to an exterior of box 10, i.e., upward in FIG. 1, from upper panel 15. Upper panel 15 is positioned opposite lower panel 16 and adjacent to lid panels 13, 14.

When hanger panel 81 and back panel 12 are glued together, hanger panel 81 may be glued to back panel 12, such that hanging opening 18 of back panel 12 and hanging opening 19 of hanger panel 81 overlap each other. Accordingly, the hanging opening 20 formed by hanging opening 18 and hanging opening 19 may be formed through hanging portion 80.

Figure 5:
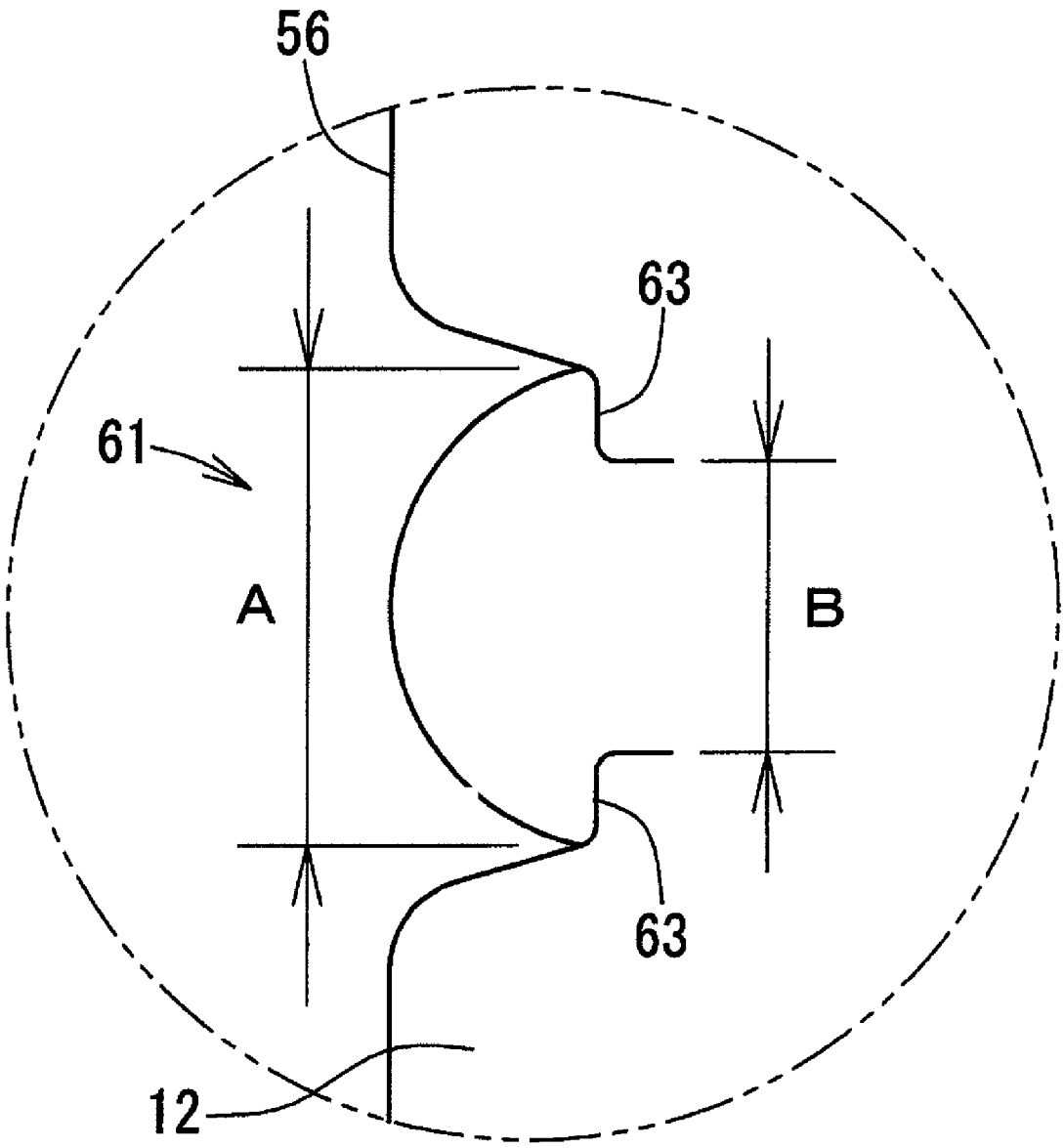
FIG. 5 is an enlarged view of a portion V surrounded by an alternate long and two short dashes line in FIG. 4.
Figure 6:
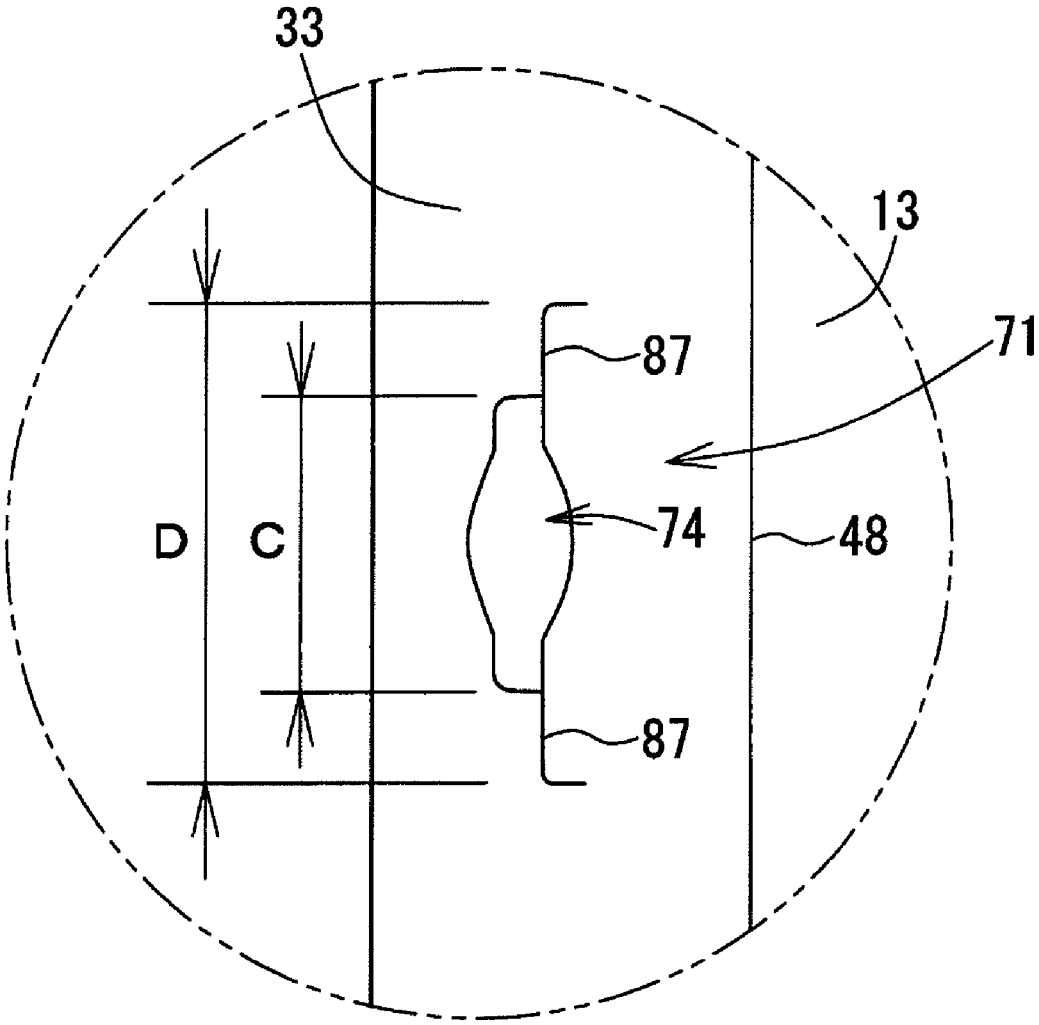
FIG. 6 is an enlarged view of a portion VI surrounded by an alternate long and two short dashes line in FIG. 4.

Referring to FIGS. 4 and 5, back panel 12 may have a left side 56, and an engaging portion 61 positioned at left side 56. Left side 56 may be contiguous with upper side 55 and lower side 58 of back panel 12. Engaging portion 61 may be formed by removing a portion of left side 56 of back panel 12, and by forming cuts 63 extending from left side 56 in back panel 12. Engaging portion 61 may have a substantially mushroom shape. Engaging portion 61 may be used for latching distal strip 33 onto back panel 12. Referring to FIGS. 4, 5, and 6, a dimension A in height direction 36 of engaging portion 61 may be slightly less than a dimension D of cuts 87 of an engaged portion 71 of distal strip 33. Therefore, engaging portion 61 may be inserted into engaged portion 71 via an insertion opening 74 and cuts 87 of engaged portion 71. A dimension B in height direction 36 between cuts 63 of engaging portion 61 may be slightly less than a dimension C of insertion opening 74 of engaged portion 71. Therefore, when engaging portion 61 is inserted into insertion opening 74 and cuts 87 of engaged portion 71, engaging portion 61 engages engaged portion 71, such that distal strip 33 is latched onto back panel 12.

Similarly, referring to FIGS. 4 and 5, back panel 12 has a right side 57, and an engaging portion 62 positioned at right side 57. Right side 57 is contiguous with upper side 55 and lower side 58 of back panel 12. Engaging portion 62 is formed by removing a portion of right side 57 of back panel 12, and by forming cuts 64 extending from right side 57 in back panel 12. Engaging portion 62 may have substantially the same shape and substantially the same size as engaging portion 61. When engaging portion 62 is inserted into an insertion opening 75 and cuts 88 of an engaged portion 72 of distal strip 34, engaging portion 62 engages engaged portion 72, such that distal strip 34 is latched onto back panel 12.

Referring to FIGS. 2 and 4, back panel 12 may have perforated lines 21 and 22 formed therein adjacent to lower side 58 of back panel 12. Perforated lines 21 and 22 may be formed by forming cuts in back panel 12 along a line at predetermined pitches. Perforated lines 21 and 22 may be used for breaking box 10. The cuts of perforated lines 21 and 22 may extend through back panel 12, between the inner and outer surfaces of back panel 12. Perforated lines 21 and 22 may extend from a first end 65 to a second end 66 of folding line 42, which corresponds to lower side 58 of back panel 12. First perforated line 21 and second perforated line 22 may be connected at a connection portion 67, which may be positioned at a midpoint of folding line 42. First perforated line 21 may have an arcuate shape having a center at a virtual center 77. Second perforated line 22 may have an arcuate shape having a center at a virtual center 78. The centers of first perforated line 21 and second perforated line 22 may be at different positions. Similarly, first perforated line 21 and second perforated line 22 may be at different positions in width direction 37. In particular, first perforated line 21 and second perforated line 22 may be at different positions along a line extending between left side 56 and right side 57 of back panel 12. Both first perforated line 21 and second perforated line 22 may extend from folding line 42 toward upper side 55 of back panel 12, and then extend back toward folding line 42, such that at least portions of both perforated lines 21 and 22 are positioned away from folding line 42.

Figure 7:
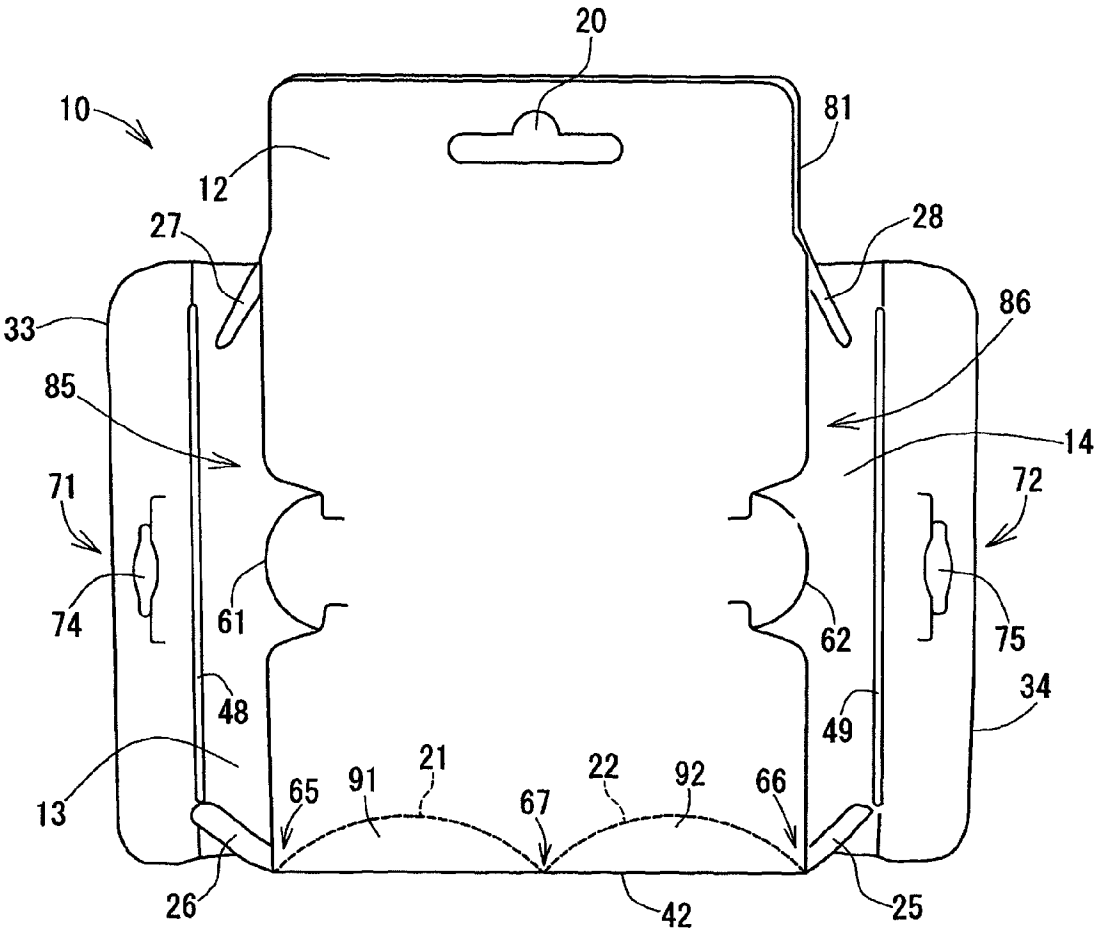
FIG. 7 is a perspective view of the box of FIG. 4, in which a back panel of the box and a hanger panel of the box are glued to each other.

Lid panel 13 may be positioned at the left face of box 10 in FIGS. 2 and 4. Lid panel 13 may be contiguous with front panel 11 via folding line 46, which corresponds to the left side of front panel 11. Lid panel 13 may be positioned opposite from lid panel 14, and adjacent to upper panel 15 and lower panel 16, when box 10 is formed. Referring to FIGS. 4 and 7, when paper board 30 is folded along folding lines 42-45, and back panel 12 and hanger panel 81 are glued together, opening 85 may be formed between left side 56 of back panel 12 and the left side of front panel 11, which corresponds to folding line 46. Similarly, opening 86 may be formed between right side 57 of back panel 12 and the right side of front panel 11, which corresponds to folding line 47. Lid panel 13 may be configured to cover opening 85, and lid panel 14 may be configured to cover opening 86.

Distal strip 33 may be contiguous with lid panel 13 via folding line 48. Lid panel 13 may be folded with respect to front panel 11 along folding line 46, which corresponds to the left side of front panel 11, thereby forming a right angle therebetween. Distal strip 33 may be folded with respect to lid panel 13 along folding line 48, such that distal strip 33 is positioned in an interior of box 10.

Referring to FIGS. 4-6, distal strip 33 may comprise engaged portion 71 at the center thereof. Engaged portion 71 may be configured to engage engaging portion 61. Therefore, engaged portion 71 may be at a position corresponding to engaging portion 61. Engaged portion 71 may comprise insertion opening 74 and cuts 87. Insertion opening 74 may be longer in height direction 36 than in width direction 37. Insertion opening 74 may be formed by cutting out a portion of distal strip 33. Cuts 87 may extend from both ends of insertion opening 74 in height direction 36. Dimension C of insertion opening 74 may be greater than dimension B between cuts 63, and less than dimension A of engaging portion 61. Dimension D of cuts 87 may be slightly greater than dimension A of engaging portion 61.

Lid panel 14 may be positioned at the right face of box 10 in FIGS. 2 and 4. Lid panel 14 may be contiguous with front panel 11 via folding line 47, which corresponds to the right side of front panel 11. Lid panel 14 may be configured to cover opening 86. When opening 85 is covered with lid panel 13 and opening 86 is covered with lid panel 14, lid panel 14 may be positioned opposite lid panel 13 and adjacent to upper panel 15 and lower panel 16.

Distal strip 34 may be contiguous with lid panel 14 via folding line 49. Lid panel 14 may be folded with respect to front panel 11 along folding line 47, which corresponds to the right side of front panel 11, thereby forming a right angle therebetween. Distal strip 34 may be folded with respect to lid panel 14 along folding line 49, such that distal strip 34 is positioned in the interior of box 10.

Referring to FIG. 4, distal strip 34 may comprise engaged portion 72 at the center thereof. Engaged portion 72 may be configured to engage engaging portion 62. Therefore, engaged portion 72 is at a position corresponding to engaging portion 62. Engaged portion 72 has insertion opening 75 and cuts 88 formed therein. Engaging portion 62, insertion opening 75, and cuts 88 may be formed in substantially the same manner as engaging portion 61, insertion opening 74, and cuts 87 of engaged portion 71.

Referring to FIGS. 2 and 4, lower panel 16 may be contiguous with back panel 12 via folding line 42, which corresponds to lower side 58 of back panel 12 and the back side of lower panel 16. Moreover, lower panel 16 may be contiguous with front panel 11 via folding line 43, which corresponds to the lower side of front panel 11 and the front side of lower panel 16. Referring to FIG. 7, when opening 85 of box 10 is covered with lid panel 13, lower panel 16 may be positioned adjacent to lid panel 13. Similarly, when opening 86 of box 10 is covered with lid panel 14, lower panel 16 may be positioned adjacent to lid panel 14.

As shown in FIG. 4, lower panel 16 may have a third perforated line 23 formed therein, and third perforated line 23 may extend straight in height direction 36. Third perforated line 23 may be formed by forming cuts in lower panel 16 along a line at predetermined pitches. Third perforated line 23 may be used for opening box 10. Third perforated line 23 may extend between front panel 11 and back panel 12. More specifically, third perforated line 23 may extend from connect portion 67 positioned at the midpoint of folding line 42 to a midpoint 68 of folding line 43. Lower panel 16 may be divided into a first lower panel 101 and a second lower panel 102 by third perforated line 23. Third perforated line 23 may be connected to first perforated line 21 and second perforated line 22 at connection portion 67.

Referring to FIGS. 4 and 7, a method of assembling packaging arrangement 100 is described. Specifically, paper board 30 may be folded along folding lines 42-45, such that hanger panel 81 contacts back panel 12. Hanger panel 81 then may be glued to the upper portion of back panel 12, including upper side 55, such that hanging opening 18 of back panel 12 and hanging opening 19 of hanger panel 81 overlap. In this manner, hanging portion 80 may be formed, as shown in FIGS. 1, 2, and 7. Opening 85 may be formed on the left face of box 10, and opening 86 may be formed on the right face of box 10, when box 10 is viewed from the back, such as in FIG. 7. As shown in FIG. 7, paper board 30 is slightly folded along folding lines 46-49.

A method of closing opening 85 of box 10 is described. Specifically, tongue strip 27 may be folded with respect to upper panel 15 into the interior of box 10, and tongue strip 26 may be folded with respect to lower panel 16 into the interior of box 10. Then, lid panel 13 may be folded along folding line 46 with respect to front panel 11, distal strip 33 may be folded along folding line 48 with respect to lid panel 13, and distal strip 33 may be inserted into the interior of box 10. Engaging portion 61 of back panel 12 then may be inserted into insertion opening 74. Consequently, opening 85 may be covered with lid panel 13 while engaging portion 61 engages engaged portion 71. In this manner, opening 85 may be covered without gluing distal strip 33 to back panel 12.

Subsequently, ink cartridge 90 may be inserted into the interior of box 10 via opening 86. After that, opening 86 of box 10 may be covered. More specifically, tongue strip 28 may be folded with respect to upper panel 15 into the interior of box 10, and tongue strip 25 may folded with respect to lower panel 16 into the interior of box 10. Then, lid panel 14 may be folded along folding line 47 with respect to front panel 11, distal strip 34 may be folded along folding line 49 with respect to lid panel 14, and distal strip 34 may be inserted into the interior of box 10. Engaging portion 62 of back panel 12 may be inserted into insertion opening 75. In this manner, opening 86 may be covered with lid panel 14, while engaging portion 62 engages engaged portion 72.

The assembling of packaging arrangement 100 may be completed in the manner described above. Moreover, because distal strip 34 may be latched onto back panel 12, it is not necessary to glue distal strip 34 to back panel 12 after ink cartridge 90 is inserted into the interior of box 10 via opening 86. Similarly, because distal strip 33 may be latched onto back panel 12, it is not necessary to glue distal strip 33 to back panel 12. Therefore, openings 85 and 86 may be reliably covered without gluing portions of box 10. In an embodiment discussed above, ink cartridge 90 is inserted into the interior of box 10 via opening 86. In another embodiment, ink cartridge 90 may be inserted into the interior of box 10 via opening 85. In such a case, opening 86 may be covered before opening 85 is covered.

Figure 8:
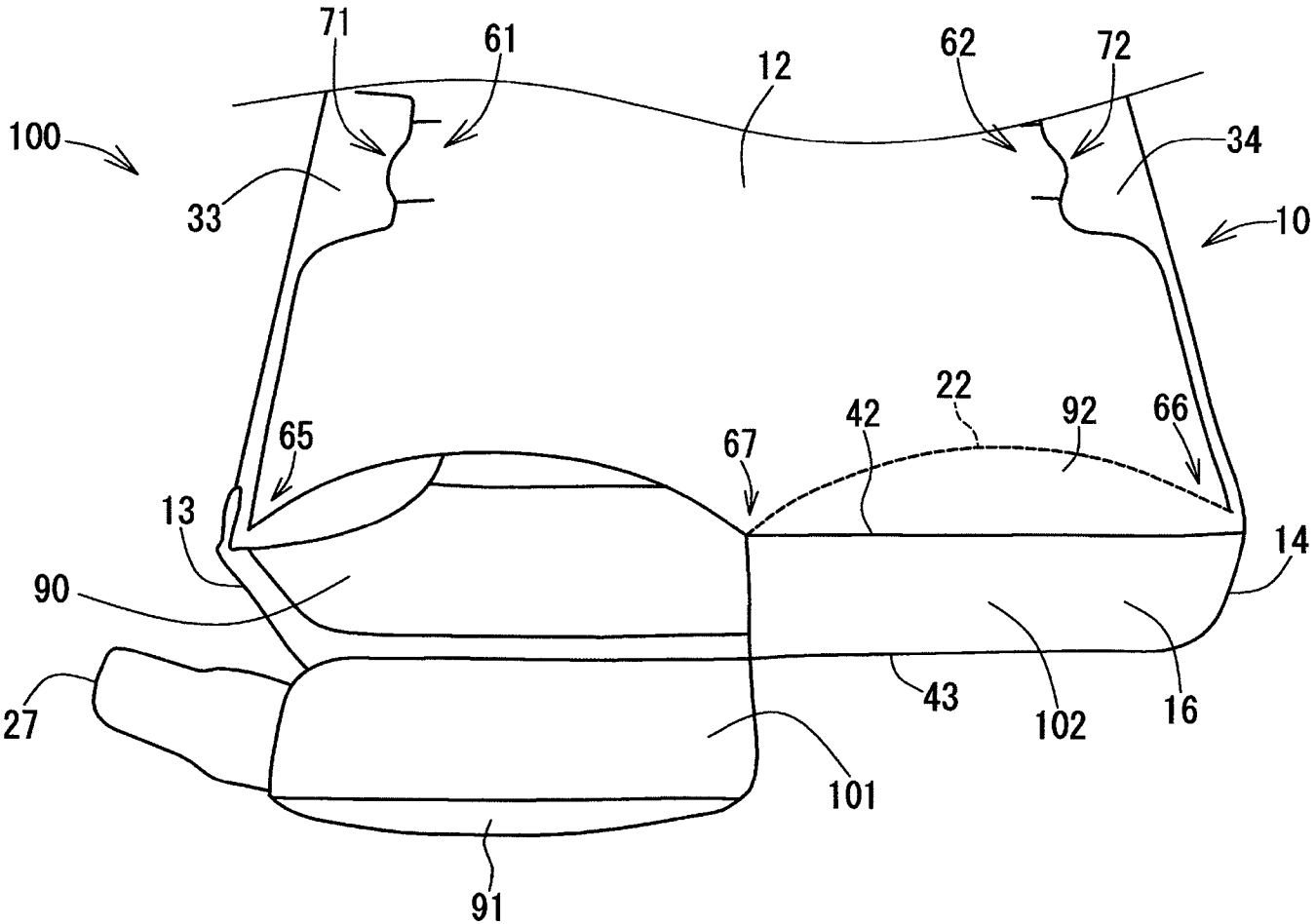
FIG. 8 is an enlarged, perspective view showing a portion of the packaging arrangement of FIG. 4, in which the box is broken along a first perforated line and a third perforated line.
Figure 9:
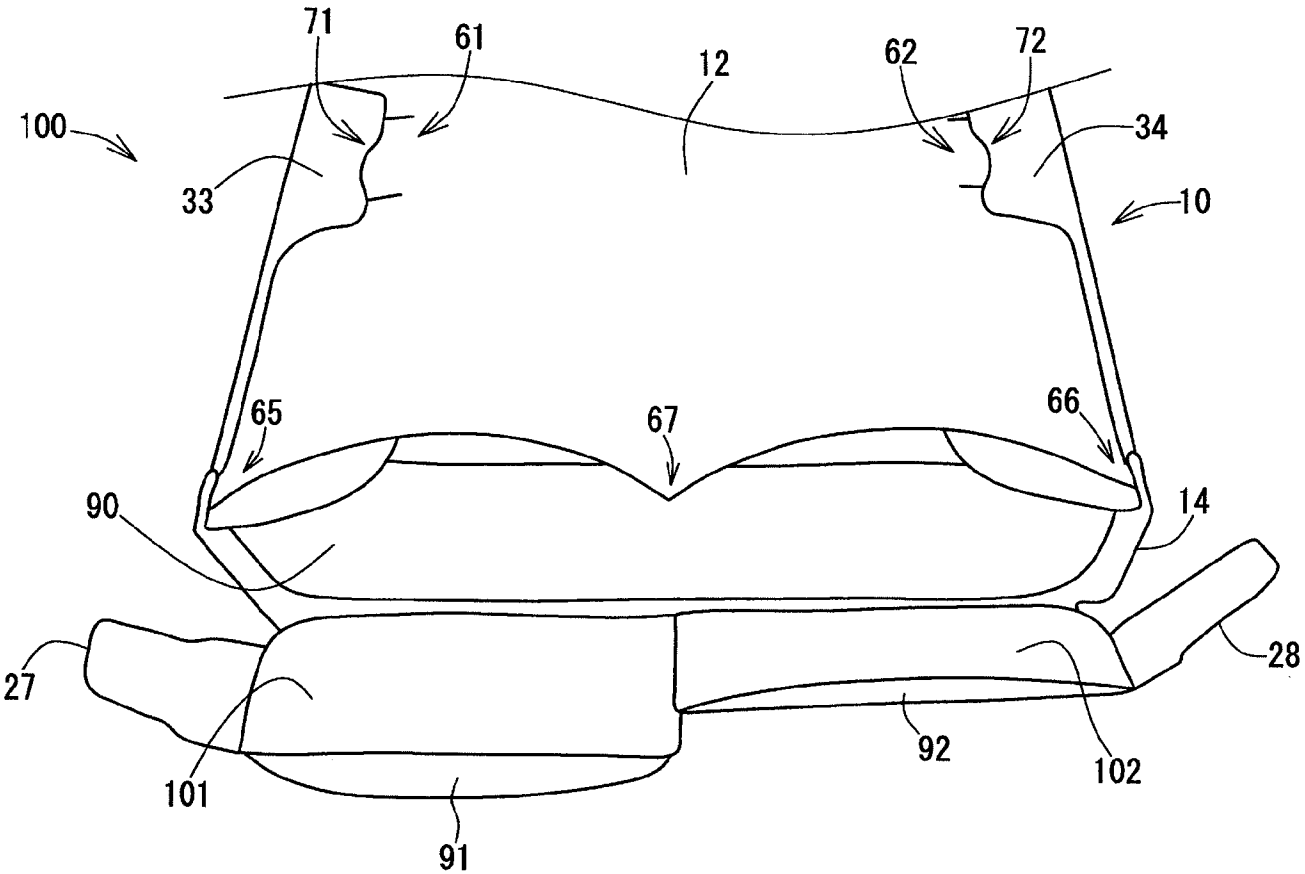
FIG. 9 is an enlarged perspective view showing a portion of the packaging arrangement of FIG. 4, in which the box is broken along the first perforated line, a second perforated line, and the third perforated line.
Figure 10:
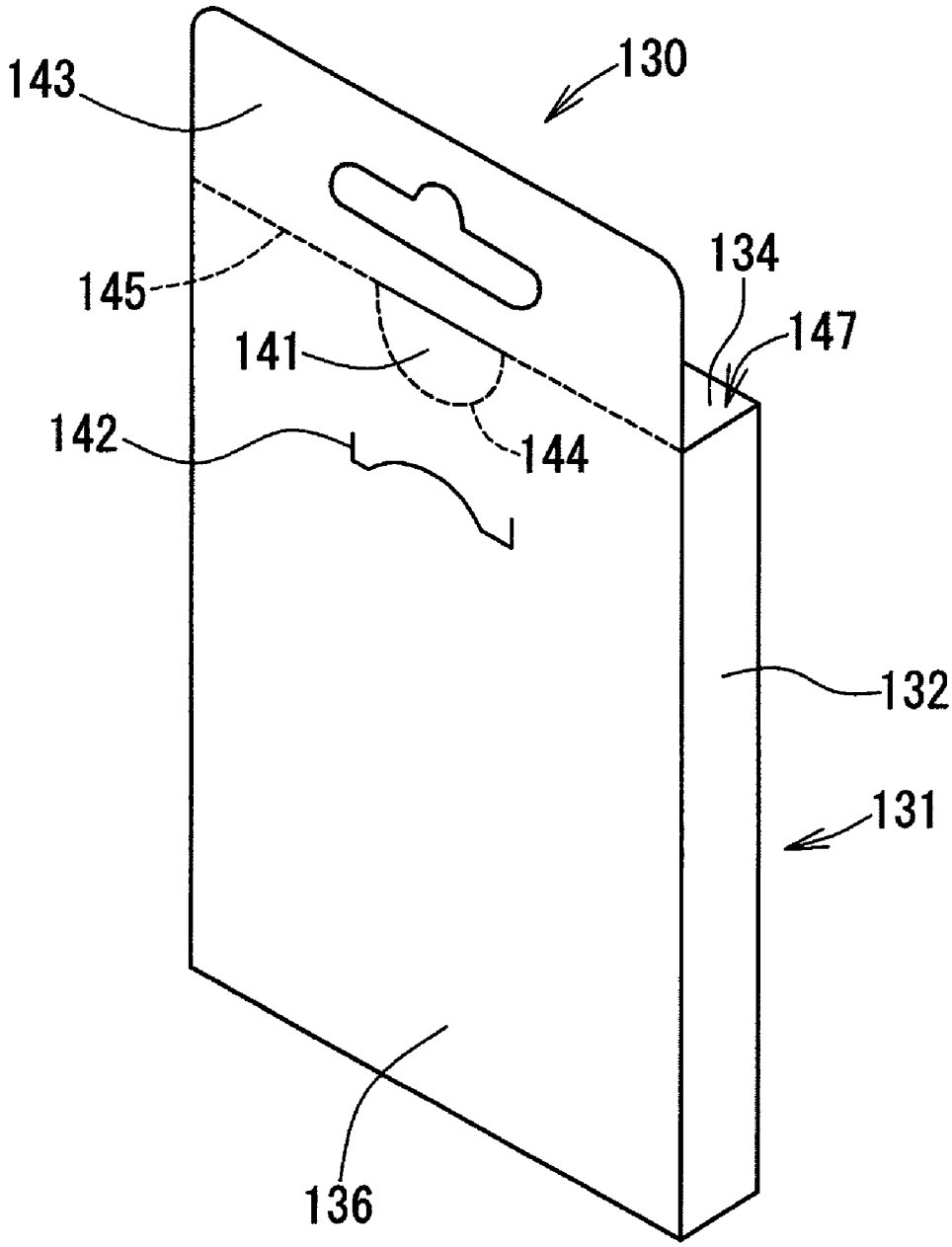
Fig. 10 Prior Art
FIG. 10 is a perspective view of a known paper box.
Figure 11:
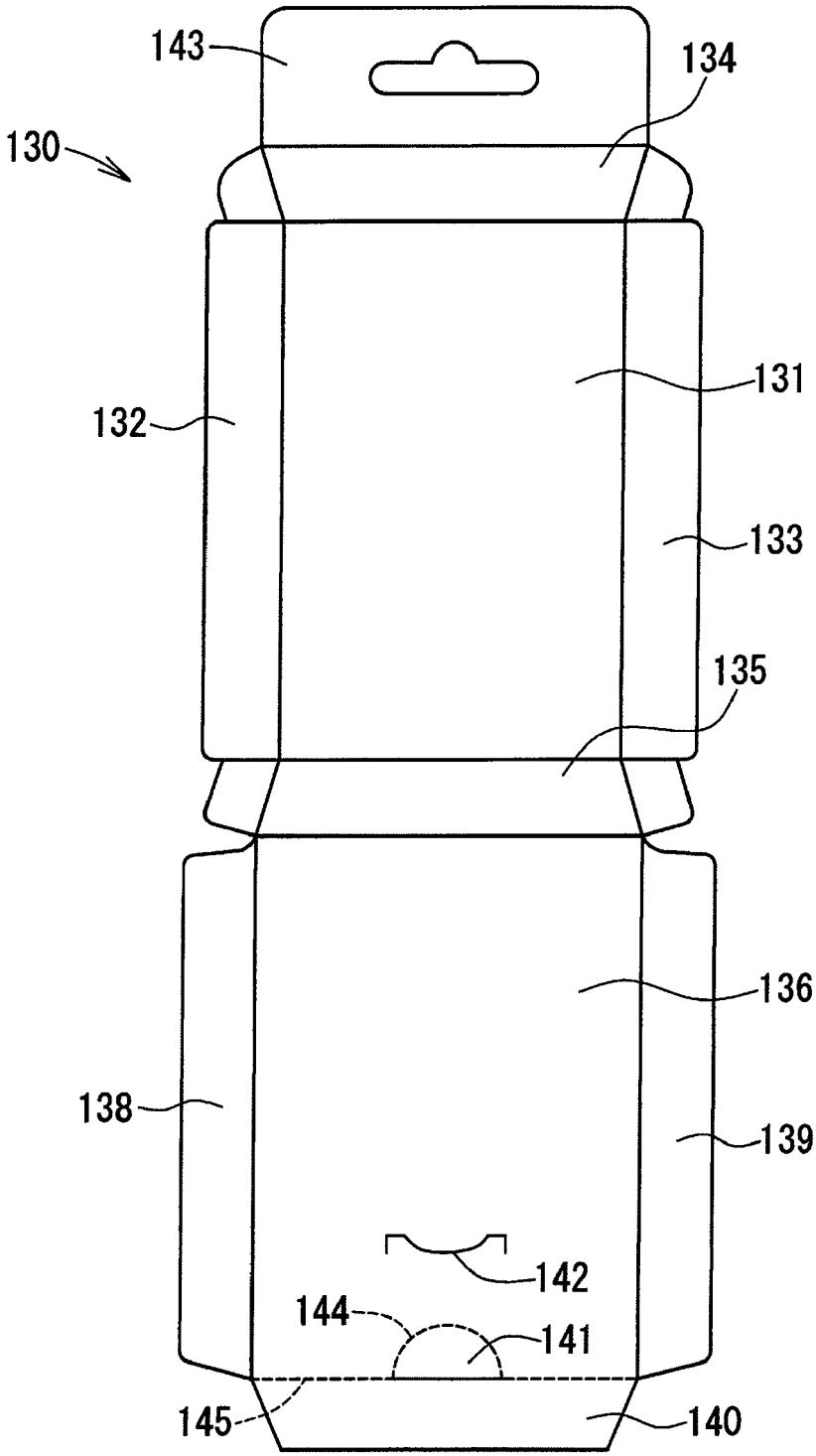
Fig. 11 Prior Art
FIG. 11 is a development view of the paper box of FIG. 10.
Figure 12:
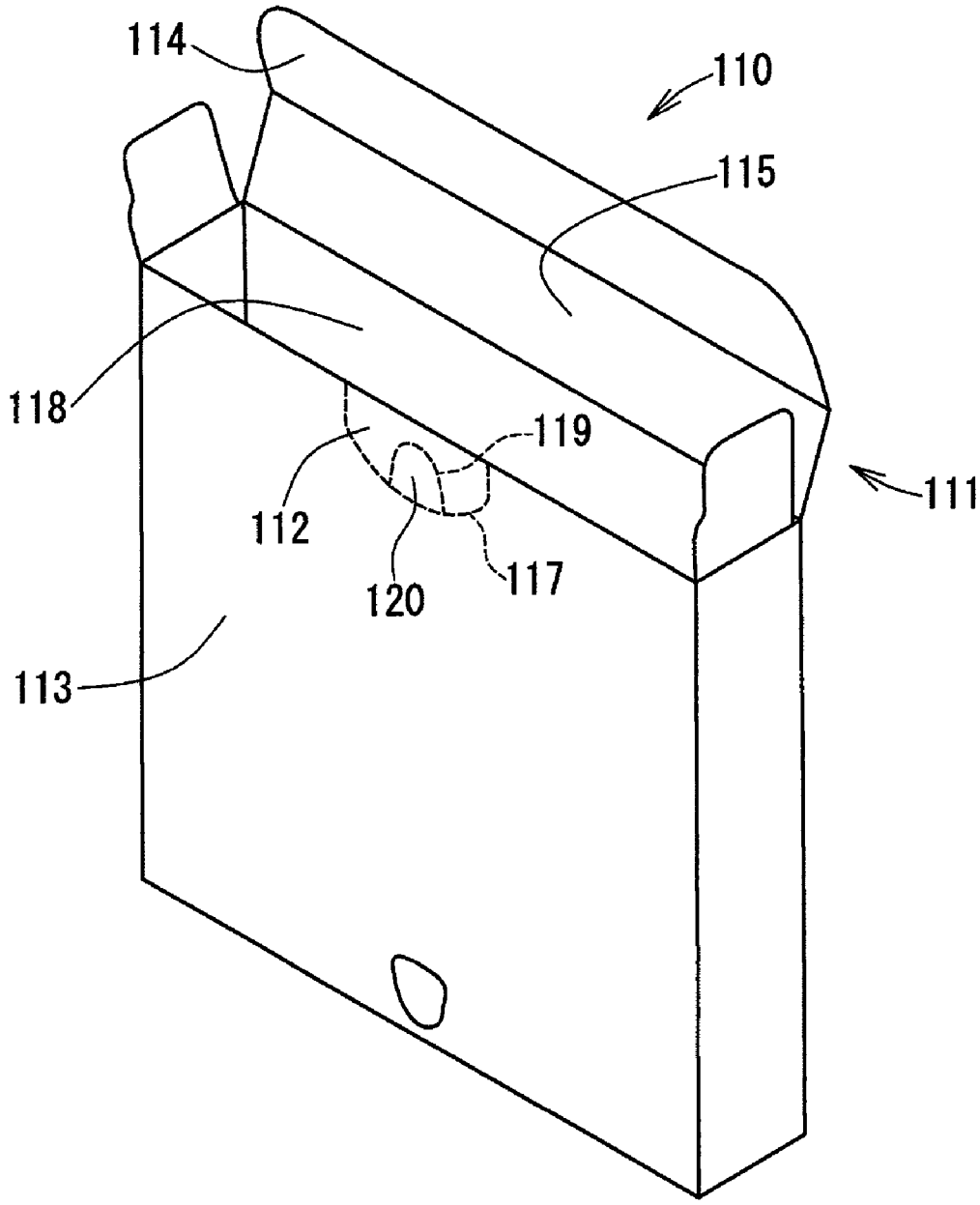
Fig. 12 Prior Art
FIG. 12 is a perspective view of another known paper box.

Referring to FIGS. 2, 8, and 9, a method of opening packaging arrangement 100 is described. Specifically, a first area 91, bordered by folding line 42 and first perforated line 21, may be pushed into the interior of box 10, e.g., using a finger, such that back panel 12 is broken along first perforated line 21. Then, first lower panel 101, which is contiguous with first area 91, may be moved toward the exterior of box 10 about folding line 43. When this occurs, because second lower panel 102 is contiguous with both back panel 12 and front panel 11, first lower panel 101 is separated from second lower panel 102 along third perforated line 23. In this manner, an opening may be formed in a portion of box 10, which had been covered with first lower panel 101, as shown in FIG. 8.

Subsequently, a second area 92, bordered by folding line 42 and second perforated line 22, may be pushed into the interior of box 10, e.g., using a finger, such that back panel 12 is broken along second perforated line 22. Then, second lower panel 102 contiguous with second area 92 may be moved toward the exterior of box 10 about folding line 43. In this manner, an opening may be formed at a portion of box 10, which had been covered with second lower panel 102, as shown in FIG. 9. An opening for removing ink cartridge 90 from box 10 thus may be formed at a portion of box 10 which had been covered with lower panel 16. Alternatively, in another embodiment, second area 92 and lower panel 102 may be opened before first panel 91 and lower panel 101.

In an embodiment of packaging arrangement 100, back panel 12 and lower panel 16 may be separated when first area 91 and second area 92 are pushed into the interior of box 10. Therefore, there is less risk that back panel 12 or lower panel 16 is broken at a portion other than perforated lines 21 and 22, when packaging arrangement 100 is opened. Therefore, it is not necessary to glue portions of box 10 to make lower panel 16 double-layered in order to achieve a reliable breakage of box 10 along a perforated line, and box 10 can be built-up easily.

According to another embodiment of packaging arrangement 100, first area 91 and second area 92 are positioned adjacent to a side, e.g., lower side 58, of back panel 12. Therefore, when first area 91 and second area 92 are pushed into the interior of box 10, first area 91 and second area 92 are less likely to contact ink cartridge 90 enclosed in box 10. Therefore, packaging arrangement 100 readily may be opened.

According to yet another embodiment of packaging arrangement 100, once box 10 is opened, it is difficult to glue lower panel 16 to back panel 12. Therefore, a previous opening of packaging arrangement 100 readily may be detected by determining whether back panel 12 and lower panel 16 are separated.

In still yet another embodiment of packaging arrangement 100, two perforated lines 21 and 22 are formed between left side 56 and right side 57 of back panel 12, which permits box 10 to be broken in two steps. Therefore, it is possible to prevent box 10 from being broken at a portion other than first perforated line 21 and second perforated line 22, and box 10 readily may be opened.

In a further embodiment of packaging arrangement 100, third perforated line 23 formed in lower panel 16 connects to first perforated line 21 and second perforated line 22. Therefore, box 10 may be broken along first perforated line 21, second perforated line 22, and third perforated line 23, independent of the size of box 10. Therefore, it is possible to prevent box 10 from being broken at a portion other than perforated lines 21-23, and box 10 readily may be opened.

In still a further embodiment of packaging arrangement 100, hanging portion 80 extends toward the exterior of box 10 from upper face 15, which is positioned opposite from lower panel 16 and adjacent to lid panels 13 and 14. Therefore, when box 10 is hung, lower panel 16 is positioned at the bottom of box 10, and lid panels 13 and 14 lie on vertical planes. Because ink cartridge 90 enclosed in box 10 is supported by lower panel 16, lid panels 13 and 14 are less likely to open due to the weight of ink cartridge 90.

In an embodiment of packaging arrangement 100, two arcuate perforated lines 21, 22 are formed in back panel 12. In another embodiment, three or more arcuate perforated lines may be formed in back panel 12. In yet another embodiment, a single arcuate line may be formed in back panel 12.

In still yet a further embodiment of packaging arrangement 100, first perforated line 21 and second perforated line 22 are formed in back panel 12. In another embodiment, first perforated line 21 and second perforated line 22 may be formed in front panel 11.

In still yet another embodiment of packaging arrangement 100, third perforated line 23 is formed in lower panel 16. In a further embodiment, third perforated line 23 may be omitted, especially when the dimension of lower panel 16 in width direction 37 is short.

In still a further embodiment of packaging arrangement 100, distal strips 33 and 34 are latched onto back panel 12 by an engagement between engaging portions 61 and 62 and engaged portions 71 and 72, respectively. In another embodiment, distal strips 33 and 34 may be glued to back panel 12. In yet another embodiment, distal strips 33 and 34 may comprise engaging portions 61 and 62, respectively, and sides 56 and 57 may comprise engaged portions 71 and 72, respectively.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A receptacle, comprising a first panel comprising a first side and a second side contiguous with the first side of the first panel;

a second panel opposite the first panel, wherein the second panel comprises a first side and a second side contiguous with the first side of the second panel, and an opening is formed between the first side of the first panel and the first side of the second panel;

a lid covering the opening and comprising a first portion and a second portion contiguous with the first portion, wherein the first portion of the lid is contiguous with the first side of the first panel, and the lid is folded such that the second portion of the lid is positioned in an interior of the receptacle; and a third panel comprising a first side and a second side opposite the first side of the third panel, wherein the first side of the third panel is contiguous with the second side of the first panel, and the second side of the third panel is contiguous with the second side of the second panel, wherein the second panel comprises an engaging portion configured to engage the second portion of the lid, wherein the second portion of the lid comprises an engaged portion having an insertion opening formed therein, wherein the engaged portion comprises a plurality of cuts extending from the insertion opening, and a height of the insertion opening is greater than a width of the insertion opening, and the engaging portion of the second panel comprises an engaging piece configured to latch the second portion of the lid onto the second panel, and wherein either the first panel has a perforation formed therein, the perforation extends from a first end of the second side of the first panel to a second end of the second side of the first panel, and at least a portion of the perforation is positioned away from the second side of the first panel, or the second panel has a perforation formed therein, the perforation extends from a first end of the second side of the second panel to a second end of the second side of the second panel, and at least a portion of the perforation is positioned away from the second side of the second panel.

2. The receptacle of claim 1, wherein the perforation comprises a plurality of arcuate lines, and a center of each of the plurality of arcuate lines is at a different position.

3. The receptacle of claim 2, wherein two of the plurality of arcuate lines are connected at a predetermined position on the second side of the first panel or on the second side of the second panel, and the third panel has a straight perforation formed therein, wherein the straight perforation extends from the predetermined position to the second side of the second panel or to the second side of the first panel, respectively.

4. The receptacle of claim 1, further comprising:

a fourth panel opposite the third panel; and a hanging portion extending from the fourth panel toward an exterior of the receptacle, wherein the hanging portion has a particular opening formed therethrough.

5. The receptacle of claim 1, wherein each of the first panel, the second panel, the third panel, and the lid comprises paper.

6. A receptacle, comprising:

a first panel comprising a first side and a second side contiguous with the first side of the first panel;

a second panel opposite the first panel, wherein the second panel comprises a first side and a second side contiguous with the first side of the second panel, and an opening is formed between the first side of the first panel and the first side of the second panel;

a lid covering the opening and comprising a first portion and a second portion contiguous with the first portion, wherein the first portion of the lid is contiguous with the first side of the first panel, and the lid is folded such that the second portion of the lid is positioned in an interior of the receptacle;

a particular lid opposite the lid, wherein a further opening is formed between the first panel and the second panel, and the particular lid covers the further opening, wherein the particular lid comprises a first portion and a second portion contiguous with the first portion of the particular lid, wherein the first portion of the particular lid is contiguous with a third side of the first panel, and the particular lid is folded such that the second portion of the particular lid is positioned in an interior of the receptacle; and a third panel comprising a first side and a second side opposite the first side of the third panel, wherein the first side of the third panel is contiguous with the second side of the first panel, and the second side of the third panel is contiguous with the second side of the second panel, wherein either the first panel has a perforation formed therein, the perforation extends from a first end of the second side of the first panel to a second end of the second side of the first panel, and at least a portion of the perforation is positioned away from the second side of the first panel, or the second panel has a perforation formed therein, the perforation extends from a first end of the second side of the second panel to a second end of the second side of the second panel, and at least a portion of the perforation is positioned away from the second side of the second panel.

7. The receptacle of claim 3, wherein the straight perforation and at least one of the plurality of arcuate perforations are configured such that a receptacle opening is formed when the straight perforation and at least one of the plurality of arcuate perforations is broken.

8. A packaging arrangement comprising:

a receptacle, comprising:

a first panel comprising a first side and a second side contiguous with the first side of the first panel;

a second panel opposite the first panel, wherein the second panel comprises a first side and a second side contiguous with the first side of the second panel, and an opening is formed between the first side of the first panel and the first side of the second panel;

a lid covering the opening and comprising a first portion and a second portion contiguous with the first portion, wherein the first portion of the lid is contiguous with the first side of the first panel, and the lid is folded such that the second portion of the lid is positioned in an interior of the receptacle;

a third panel comprising a first side and a second side opposite the first side of the third panel, wherein the first side of the third panel is contiguous with the second side of the first panel, and the second side of the third panel is contiguous with the second side of the second panel, wherein the second panel comprises an engaging portion configured to engage the second portion of the lid, wherein the second portion of the lid comprises an engaged portion having an insertion opening formed therein, wherein the engaged portion comprises a plurality of cuts extending from the insertion opening, and a height of the insertion opening is greater than a width of the insertion opening, and the engaging portion of the second panel comprises an engaging piece configured to latch the second portion of the lid onto the second panel, and wherein either the first panel has a perforation formed therein, the perforation extends from a first end of the second side of the first panel to a second end of the second side of the first panel, and at least a portion of the perforation is positioned away from the second side of the first panel, or the second panel has a perforation formed therein, the perforation extends from a first end of the second side of the second panel to a second end of the second side of the second panel, and at least a portion of the perforation is positioned away from the second side of the second panel; and an ink cartridge enclosed in the receptacle.

9. The packaging arrangement of claim 8, wherein the perforation comprises a plurality of arcuate lines, and a center of each of the plurality of arcuate lines is at a different position.

10. The packaging arrangement of claim 9, wherein two of the plurality of arcuate lines are connected at a predetermined position on the second side of the first panel or on the second side of the second panel, and the third panel has a straight perforation formed therein, wherein the straight perforation extends from the predetermined position to the second portion of the second panel or to the second portion of the first panel, respectively.

11. The packaging arrangement of claim 8, wherein the receptacle further comprises:

a fourth panel opposite the third panel; and a hanging portion extending from the fourth panel toward an exterior of the receptacle, wherein the hanging portion has a particular opening formed therethrough.

12. The packaging arrangement of claim 8, wherein each of the first panel, the second panel, the third panel, and the lid comprises paper.

13. A packaging arrangement comprising:

a receptacle, comprising:

a first panel comprising a first side and a second side contiguous with the first side of the first panel;

a second panel opposite the first panel, wherein the second panel comprises a first side and a second side contiguous with the first side of the second panel, and an opening is formed between the first side of the first panel and the first side of the second panel;

a lid covering the opening and comprising a first portion and a second portion contiguous with the first portion, wherein the first portion of the lid is contiguous with the first side of the first panel, and the lid is folded such that the second portion of the lid is positioned in an interior of the receptacle;

a particular lid opposite the lid, wherein a further opening is formed between the first panel and the second panel, and the particular lid covers the further opening, wherein the particular lid comprises a first portion and a second portion contiguous with the first portion of the particular lid, wherein the first portion of the particular lid is contiguous with a third side of the first panel, and the particular lid is folded such that the second portion of the particular lid is positioned in an interior of the receptacle; and a third panel comprising a first side and a second side opposite the first side of the third panel, wherein the first side of the third panel is contiguous with the second side of the first panel, and the second side of the third panel is contiguous with the second side of the second panel, wherein either the first panel has a perforation formed therein, the perforation extends from a first end of the second side of the first panel to a second end of the second side of the first panel, and at least a portion of the perforation is positioned away from the second side of the first panel, or the second panel has a perforation formed therein, the perforation extends from a first end of the second side of the second panel to a second end of the second side of the second panel, and at least a portion of the perforation is positioned away from the second side of the second panel; and an ink cartridge enclosed in the receptacle.

14. The packaging arrangement of claim 10, wherein the straight perforation and at least one of the plurality of arcuate perforations are configured such that a receptacle opening is formed when the straight perforation and at least one of the plurality of arcuate perforations is broken.

15. The receptacle of claim 6, wherein the perforation comprises a plurality of arcuate lines, and a center of each of the plurality of arcuate lines is at a different position.

16. The receptacle of claim 15, wherein two of the plurality of arcuate lines are connected at a predetermined position on the second side of the first panel or on the second side of the second panel, and the third panel has a straight perforation formed therein, wherein the straight perforation extends from the predetermined position to the second portion of the second panel or to the second portion of the first panel, respectively.

17. The receptacle of claim 6, wherein the second panel comprises an engaging portion configured to engage the second portion of the lid.

18. The receptacle of claim 6, wherein the receptacle further comprises:

a fourth panel opposite the third panel; and a hanging portion extending from the fourth panel toward an exterior of the receptacle, wherein the hanging portion has a particular opening formed therethrough.

19. The receptacle of claim 6, wherein each of the first panel, the second panel, the third panel, and the lid comprises paper.

20. The receptacle claim 16, wherein the straight perforation and at least one of the plurality of arcuate perforations are configured such that a receptacle opening is formed when the straight perforation and at least one of the plurality of arcuate perforations is broken.

* * * * *